US007441658B2

(12) United States Patent
McDowell

(10) Patent No.: US 7,441,658 B2
(45) Date of Patent: Oct. 28, 2008

(54) CONTAINER FOR GLASS PRODUCTS

(75) Inventor: Richard B. McDowell, Ligonier, PA (US)

(73) Assignee: Menasha Corporation, Neenah, WI (US)

( * ) Notice: Subject to any disclaimer, the term of this patent is extended or adjusted under 35 U.S.C. 154(b) by 97 days.

(21) Appl. No.: 11/483,063

(22) Filed: Jul. 7, 2006

(65) Prior Publication Data

US 2008/0006555 A1 Jan. 10, 2008

(51) Int. Cl.
*B65D 85/48* (2006.01)

(52) U.S. Cl. ..... 206/448; 206/454; 206/592; 206/594

(58) Field of Classification Search ..... 206/386, 206/449, 454, 591, 592, 594, 448
See application file for complete search history.

(56) References Cited

U.S. PATENT DOCUMENTS

| | | | |
|---|---|---|---|
| 2,171,051 | A | 8/1939 | Stonecypher |
| 2,331,753 | A | 10/1943 | Wohlers |
| 2,665,804 | A | 1/1954 | Koester |
| 2,673,023 | A | 3/1954 | Vander Lugt, Jr. |
| 2,734,626 | A | 2/1956 | Koester et al. |
| 2,743,010 | A | 4/1956 | Koester |
| 2,806,592 | A | 9/1957 | Hatfield |
| 2,839,198 | A | 6/1958 | Lefevre |
| 2,981,407 | A | 4/1961 | Gaulke et al. |
| 3,159,275 | A | 12/1964 | Van Antwerpen et al. |
| 3,403,778 | A | 10/1968 | Voytko et al. |
| 3,469,762 | A | 9/1969 | La Torre |
| 3,476,303 | A | 11/1969 | Smith |
| 3,493,128 | A | 2/1970 | Silvert |
| 3,519,244 | A | 7/1970 | Lidgard |
| 3,616,986 | A | 11/1971 | Wolfe |
| 3,884,356 | A | 5/1975 | Lidgard |
| 3,938,660 | A | 2/1976 | Moehring |
| 3,985,231 | A | 10/1976 | Farhat et al. |
| 4,014,435 | A | 3/1977 | Rowley et al. |
| 4,086,263 | A | 4/1978 | Rowley |
| 4,098,401 | A | 7/1978 | Brown et al. |
| 4,225,043 | A | 9/1980 | Lastik |

(Continued)

FOREIGN PATENT DOCUMENTS

| | | |
|---|---|---|
| CA | 1097283 | 3/1981 |

(Continued)

*Primary Examiner*—Jacob K Ackun, Jr.
(74) *Attorney, Agent, or Firm*—Ungaretti & Harris LLP

(57) ABSTRACT

A container for transporting a plurality of curved glass sheets lined up side by side. The container includes a bottom structure, such as a pallet, a back wall extending upward from the bottom structure, a first side wall connected to a first end of the back wall and extending upward from the bottom structure, and a second side wall connected to a second end of the back wall and extending upward from the bottom structure. The container includes a cradle portion proximate the back wall extending into an interior portion of the container. The cradle portion including a glass sheet supporting surface for contacting a backmost one of the plurality of glass sheets. The supporting surface has a radius of curvature to correspond with the curvature of the backmost one of the plurality of glass sheets. The container also includes two back corner support structures, each configured to support a portion of the respective side walls and a portion of the back wall.

20 Claims, 6 Drawing Sheets

U.S. PATENT DOCUMENTS

| | | | |
|---|---|---|---|
| 4,317,536 | A | 3/1982 | Dickerson |
| 4,467,922 | A | 8/1984 | Rowley |
| 4,477,015 | A | 10/1984 | Lozaun |
| 4,489,835 | A | 12/1984 | Tombal et al. |
| 4,697,731 | A | 10/1987 | Snyder |
| 5,105,946 | A | 4/1992 | McDowell |
| 5,174,448 | A | 12/1992 | Flaig |
| 5,372,255 | A | 12/1994 | Skorski |
| 5,575,389 | A | 11/1996 | Alspach |
| 6,267,255 | B1 | 7/2001 | Brush |

FOREIGN PATENT DOCUMENTS

| | | |
|---|---|---|
| GB | 1332546 | 10/1973 |

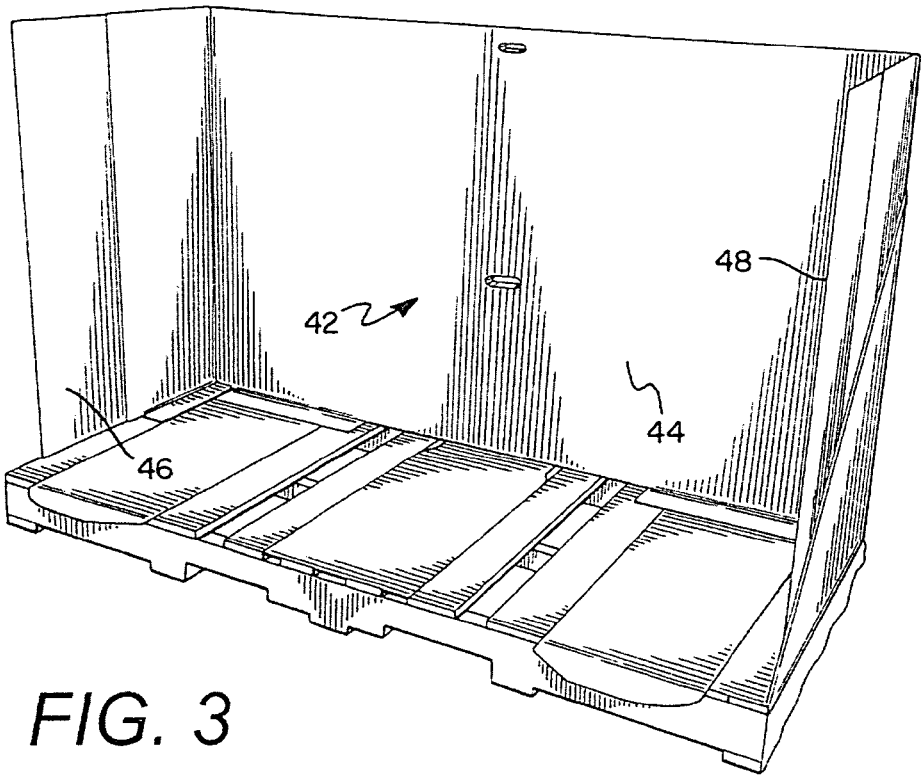
FIG. 3
FIG. 4
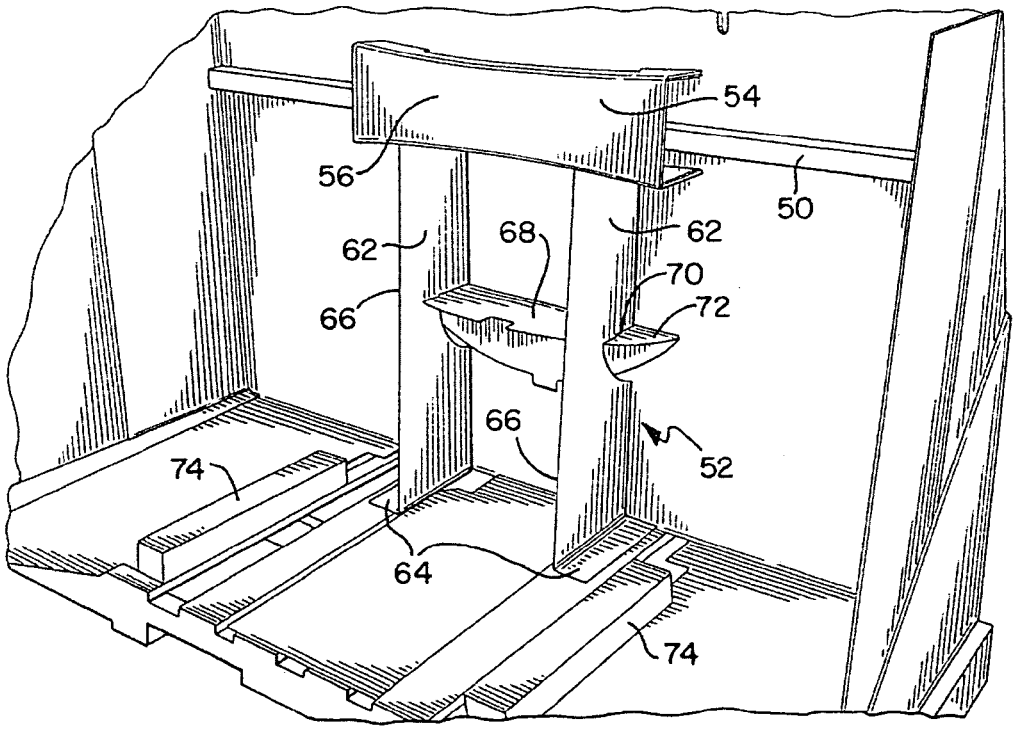

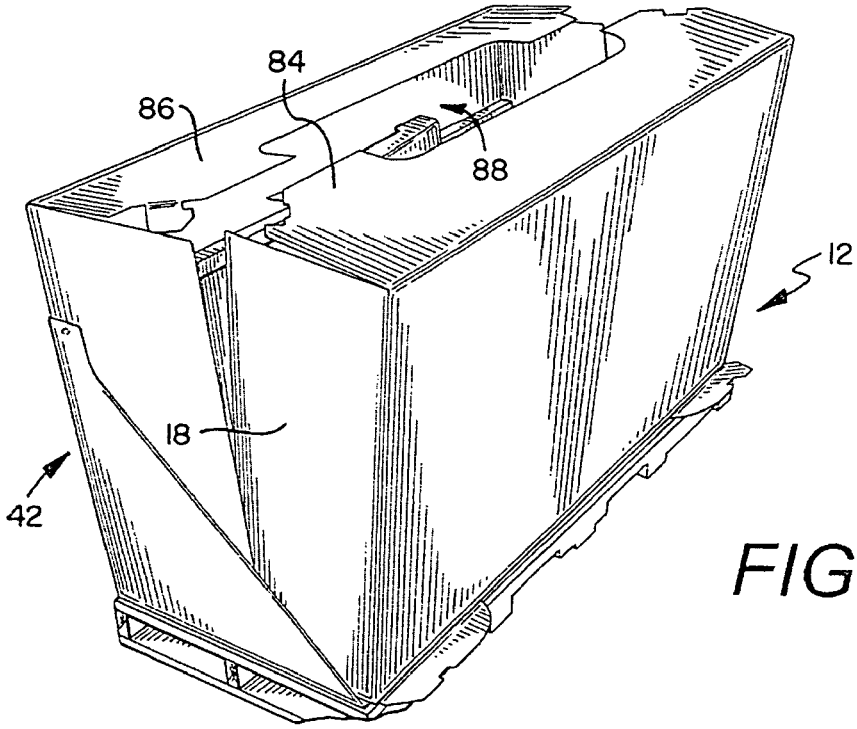
FIG. 7
FIG. 8
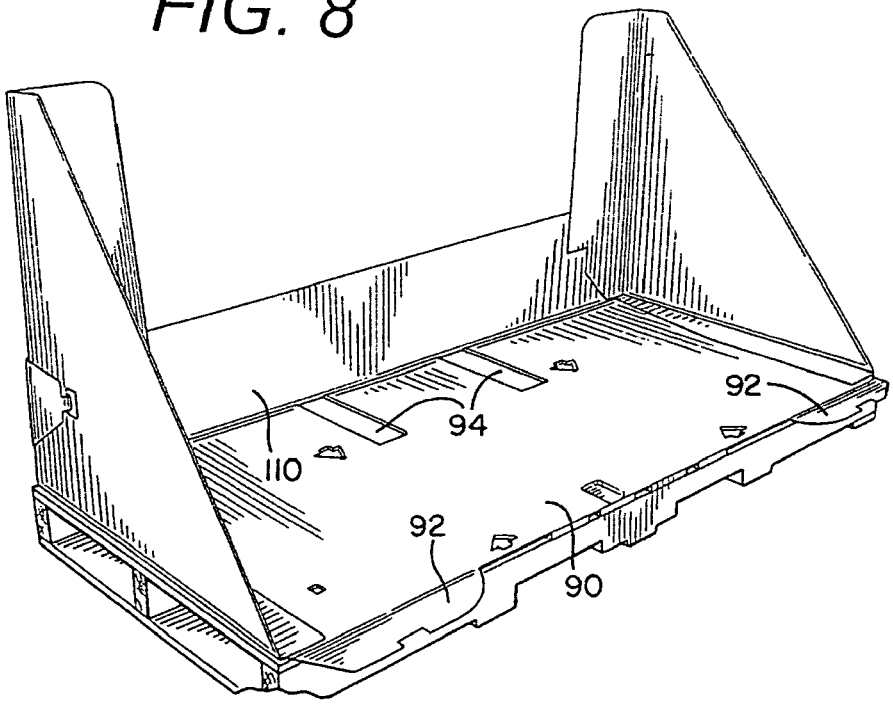

CONTAINER FOR GLASS PRODUCTS

CROSS-REFERENCE TO RELATED APPLICATIONS

None.

FEDERALLY SPONSORED RESEARCH OR DEVELOPMENT

N/A

TECHNICAL FIELD

The invention relates to a container for transporting fragile products, and more particularly to a corrugated box container for transporting glass products, such as windshields used in the automotive industry.

BACKGROUND OF THE INVENTION

Containers for shipping glass sheets, such as windshields used in automobiles and trucks, are typically corrugated structures or wood crates (or a combination thereof) supported on a wood pallet. The containers are preassembled or occasionally shipped in components to the glass sheet manufacturer and are set up or assembled on-site.

It is important for such containers to be able to securely support the glass and withstand the rigors of transportation and be capable of stacking to maximize warehouse space. This includes providing a snug fit for the glass. It is also necessary for the containers to withstand banding pressures from straps or bands utilized in shipping.

The present invention is provided to solve the problems discussed above and other problems and to provide advantages and aspects not provided by prior containers of this type. A full discussion of the features and advantages of the present invention is deferred to the following detailed description, which proceeds with reference to the accompanying drawings.

SUMMARY OF THE INVENTION

The present invention is directed to a container for transporting sheets of glass, such as automotive windshields. The container is configured to support the glass sheets in an upright position (i.e., along each sheet's bottom or top edge), and includes a cradle support which conforms to the curve or bend of the sheet. That is, a supporting surface of the cradle support is contoured to provide a closer or more snug fit against the glass sheets. Thus, distributing the weight across the cradle surface without hard edges that could create pressure points. The container also includes back corner support structures configured to support a portion of the side walls and a portion of the back wall. A top having a reinforced lip to withstand banding pressures is also provided. The top can be a separate piece, or can be formed from flaps extending from other components of the container.

The container is made from components that can be shipped and stored in a relatively flat, or a condensed or compact configuration. The container is preferable then set up or assembled on location before being loaded with glass sheets.

In accordance with one embodiment of the invention, a container for transporting a plurality of curved glass sheets lined up side by side is provided. The container comprises a bottom structure, a back wall extending upward from the bottom structure, a first side wall connected to a first end of the back wall and extending upward from the bottom structure, and a second side wall connected to a second end of the back wall and extending upward from the bottom structure. The bottom structure can be a wooden or plastic pallet having end and side openings for forklift tines.

The container also includes a cradle portion proximate the back wall extending into an interior portion of the container. The cradle portion includes a glass sheet supporting surface for contacting a backmost one of the plurality of glass sheets. The supporting surface is configured to have a radius of curvature to parrot with the backmost one of the plurality of glass sheets. The cradle portion is supported by a first cradle support panel extending upward from the bottom structure to the cradle portion, and a second cradle support panel extending upward from the bottom structure to the cradle portion. The support panels include a front support surface inclined at an angle to the back wall of the container. A cross-support panel or brace can be provide between the first and second support panels, preferably a bout midway from the bottom structure to the cradle portion.

The container can further include a reinforcing member positioned and secured in the back half of the container extending along the back wall between the first side wall and the second side wall. The reinforcing member can be a wood beam. According to one variation of the container, the cradle portion is centered or positioned about the reinforcing member and located at a fixed height behind the glass sheets (when loaded onto the container) to provide maximum support against the reinforcing member which distributes weight to the corners of the container.

The back wall, first side wall, second side wall and cradle portion are formed from a corrugated material, such as cardboard. The back wall and side walls can be formed from a single blank having scorelines for folding the side walls .

The container can further include a first corner support structure configured to support a portion of the first side wall and a first portion of the back wall adjacent the portion of the first side wall and, a second corner support structure configured to support a portion of the second side wall and a second portion of the back wall adjacent the portion of the second side wall. The corner portions can also be formed from a corrugated material.

The container further comprises a front wall extending upward from the bottom structure and a top panel extending between the front wall and the back wall, and the first side wall and the second side wall. The front wall and top panel can also be formed from a corrugated material. Additionally, the front wall and the back wall can be identical.

In accordance with another embodiment of the invention, a container for transporting a plurality of curved glass sheets comprises a bottom pallet structure, a substantially rectangular back wall connected to a back edge portion of the bottom pallet and extending upward therefrom, the back wall including a first side wall connected to a first side of the back wall and a second side wall connected to a second side of the back wall. The container also includes a cradle portion connected to a mid portion of the back wall for engaging and supporting the plurality of curved glass sheets; a first corner support having a side support wall for supporting a portion of the first side wall and a back support wall for supporting a first portion of the back wall and a second corner support having a side support wall for supporting a portion of the second side wall and a back support wall for supporting a second portion of the back wall. The bottom pallet structure includes a floor portion comprising a corrugated material.

The cradle portion includes a curved cradle support surface having a contour configured to mate with the contour of the backmost curved glass sheet of the plurality of curved glass sheets. The cradle portion also includes a wall separation portion connected to the back wall and the cradle support surface for maintaining the cradle support surface in an interior portion of the container spaced from the back wall.

The container also comprises a reinforcing beam extending along the back wall. The reinforcing beam is positioned to be in line with the glass sheets. Importantly, the cradle portion is located at a fixed height, putting it and the reinforcing beam directly behind the glass sheets when loaded in the container. The wall separation portion is positioned so that it spans a mid-portion of the reinforcing beam.

The container further includes a front wall having a first side wall connected to a first side of the front wall and a second side wall connected to a second side of the front wall. The first side wall and the second side wall connected to the front wall are configured to overlap the first side wall and second side wall connected to the back wall.

The container further includes a corrugated top panel having a lip extending downward around the periphery of the top panel. The lip is reinforced to resist pressure from banding of the container. The reinforcement can be provided by having a plurality of layers of cardboard in the lip.

Alternatively, the top of the container can be formed from a first flap and a second flap extending from the front and back walls, respectively. The flaps can abut when folded to counter banding pressure.

In accordance with yet a f further embodiment of the invention, a container for transporting a plurality of glass windshields used for automobiles is provided. The container includes a bottom structure, and a back wall connected to the bottom structure along a bottom edge of the back wall. The back wall includes a first side wall extending from a first side of the back wall and a second sidewall extending from a second side of the back wall. The back wall, first side wall and second side wall are formed from a contiguous corrugated cardboard blank.

The container also includes a corrugated cardboard cradle portion connected to the back wall. The cradle portion including a generally rectangular support surface having a curvature for mating with the plurality of glass windshields.

Additionally, the container includes a first corner support having a side supporting portion for supporting a portion of the first side wall and a back supporting portion for supporting a first portion of the back wall. The side supporting portion and the back supporting portion of the first corner support are formed from a contiguous corrugated cardboard blank. A second corner support having a side supporting portion for supporting a portion of the second side wall and a back supporting portion for supporting a second portion of the back wall can be provided for the other back corner of the container. Similar to the first corner support, the side supporting portion and the back supporting portion of the second corner portion are formed from a contiguous corrugated cardboard blank.

The container further comprises a front portion connected to the bottom structure. The front portion includes a front wall, a first side wall connected to a first side of the front wall and a second side wall connected to a second side of the front wall. The front wall, first side wall connected to the front wall and second side wall connected to the front wall are formed from a contiguous corrugated cardboard blank.

The container further comprises a corrugated cardboard top portion including a top panel surrounded by a lip. The lip includes a roll-up reinforcement to withstand banding pressure. Alternatively, the front wall and the back wall can each include a flap connected to the top edge of the walls. The flaps can be bent to form a top wall of the container.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 3 is a perspective view of container components of FIG. 2 including a back portion;

FIG. 4 is a perspective view of the container components of FIG. 3 including a cradle portion;

FIG. 7 is a perspective view of another embodiment of a container for glass sheets in accordance with the present invention;

FIG. 8 is a perspective view of components of an alternative embodiment of the container including a single floor support;

DETAILED DESCRIPTION

Figure 1:
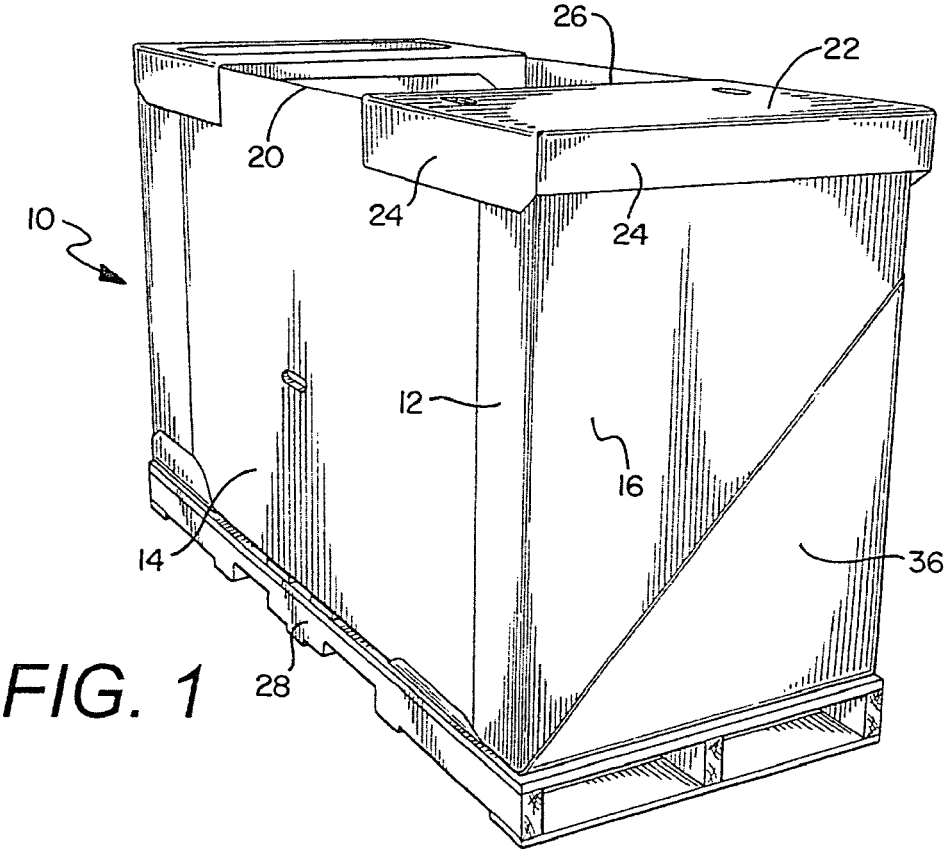
FIG. 1 is a perspective view of a container for glass sheets made in accordance with the teachings of an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a container for transporting sheets of glass, such as glass windshields utilized for automobiles. The container is constructed from components that can be collapsed for shipping. The containers can then be set up on location (e.g., a windshield manufacturing facility) and loaded with the glass sheets.

Referring to FIG. 1, a container 10 for holding glass sheets is shown. The container 10 includes a front section 12 having a front wall 14. The front section 12 further includes a first side wall 16 integrally connected to the front wall 14 along one side, and a second opposing side wall 18 (see FIG. 7) extending from the front wall 14 along the front wall's other side. The front section 12 is preferably formed from a corrugated cardboard material. The material is cut as single blank piece where the side walls 16, 18 are formed by bending the blank at the appropriate locations. Scorelines or hinge lines can be formed in the blank to facilitate bending the material to form the desired shape of the front section 12. Similar techniques can be used for other components of the container 10.

The container includes a corrugated cardboard cap or top portion 20 having a top wall 22 and a lip 24 extending around the entire periphery of the top wall 22. The lip 24 includes reinforcement to withstand banding pressures from straps placed around the container 10 during shipping. The reinforcement can be provided by folding over several layers of the corrugated cardboard when forming the lip 24.

The top portion 20 also includes an opening 26 for allowing visual inspection of the glass sheets during transport and/or storage. The opening 26 also allows for placement and removal of dunnage used to secure the glass sheets in the container 10 and acting as shock absorbing material.

Figure 2:
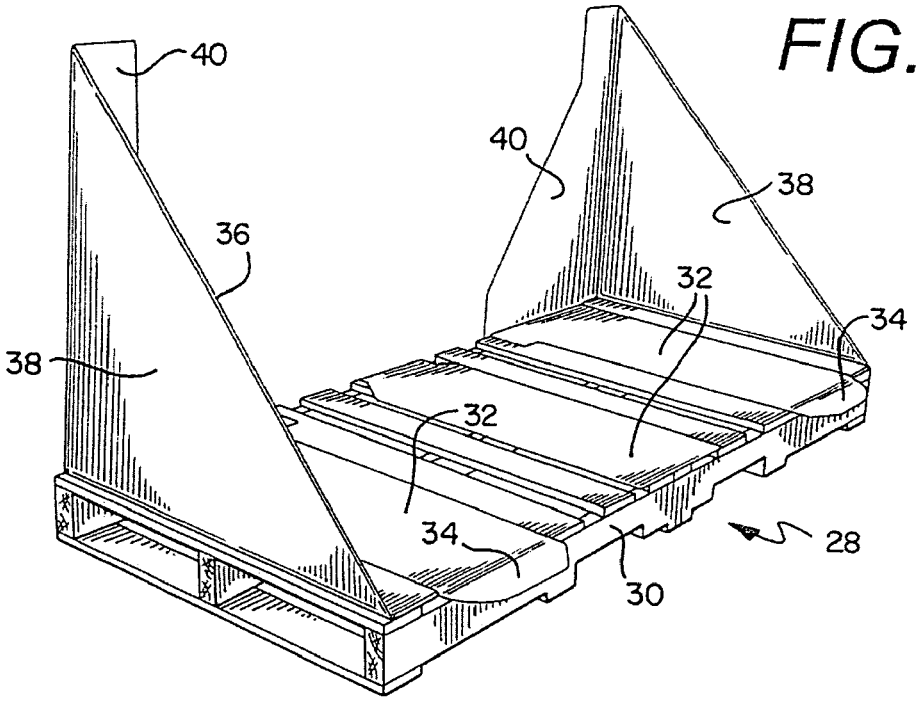
FIG. 2 is a perspective view of components of the container of FIG. 1 including a bottom portion and corner portions of the container.

The front section 12 is supported on a bottom portion 28. As shown in FIG. 2, the bottom portion 28 includes a wood frame pallet structure 30, and corrugated floor supports 32. The floor supports 32 on the ends of the pallet 30 include a tab 34 that extends outward beyond the front of the pallet frame structure 30 that can be used to facilitate connection of the bottom portion 28 to the front section 12. Similar tabs at the back of the floor supports 32 can be used to connect the supports to the back portions of the container.

The container 10 also includes two corrugated cardboard corner supports 36 positioned toward the back two corners of the container 10. Each corner support 36 includes a side support portion 38. The side support portion 38 has inclines with a diagonal edge starting towards the top from the back and ending towards the front of the container 10 near the pallet. The material is double thickness where fastened to the pallet 30 for maximum tear resistance. Also, each corner support 36 includes a back support portion 40 for supporting a portion of a back section 42 (see e.g., FIG. 3) of the container 10.

As shown in FIG. 3, the back section 42 includes a back wall 44 integrally connected to a first side wall 46 and a second side wall 48. The side walls 46,48 of the back section 42 are configured to fit within the side walls 16,18 of the front section 12 when the container 10 is fully set up. Similar to the front section 12, the back section 42 is preferably configured from a single blank piece of material.

Figure 5:
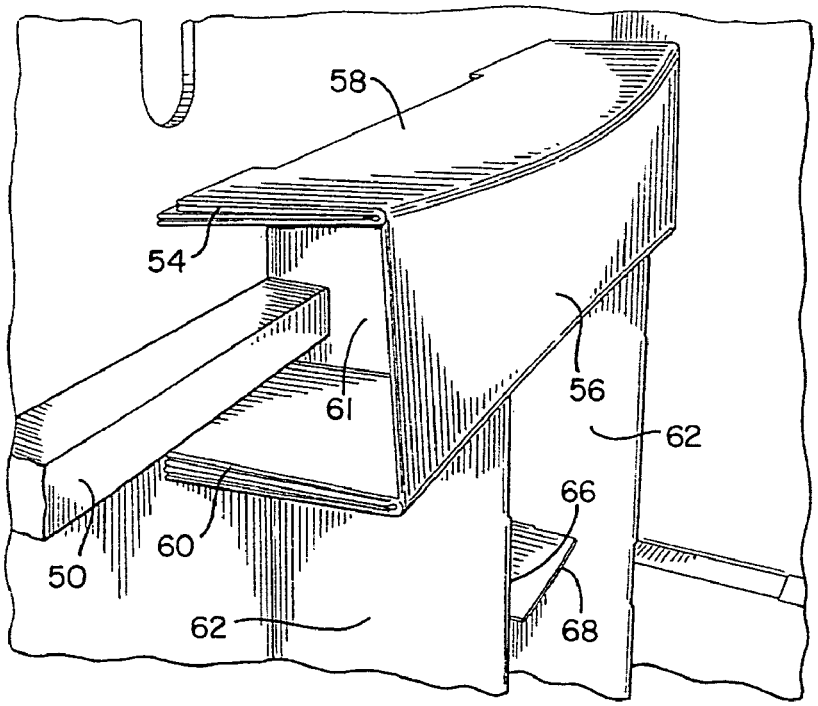
FIG. 5 is a perspective view of a portion of the cradle portion of FIG. 4.

FIGS. 4 and 5 show internal structure used in the container 10 for supporting the glass sheets and providing additional reinforcement to the container 10. A wood beam or brace 50 is positioned along the back wall 44. The brace 50 spans from the first side wall 46 to the second side wall 48, and is in line with a cradle portion 54.

A corrugated cardboard cradle 52 is also positioned midway against the back wall 44. The cradle 52 extends from the bottom portion 28 to just above the brace 50. The cradle 52 includes the cradle portion 54 having a front facing cradle support surface 56, a top member 58 and a bottom member 60 extending from the top and bottom, respectively, of the front surface 56 to the back wall 44. The cradle portion 54 is centered about the brace 50 and includes an internal support structure 61 (as shown in FIG. 5) between the support surface 56, top member 58, bottom member 60 and the brace 50.

The cradle portion 54 is supported by two cradle support panels 62. The support panels 62 extend from the bottom portion 28 to the bottom member 60 of the cradle portion 54. Each panel 62 includes a flap 64 glued or otherwise secured to the bottom portion 28. The panels 62 include a front facing edge 66 inclined at an angle with respect to the plane of the back wall 44. That is, the base of each panel 62 is wider than the top portion of the panel 62 connected to the bottom member 60 of the cradle portion 54.

A cross-support panel 68 is provided between the support panels 62 to brace the panels 62. The cross-support panel 68 is positioned to bridge the cradle support panels 62 at a mid-portion of the panels 62. One or more of the support panels 62 can be provided with a slot 70 to allow a portion 72 of the cross-panel 68 to extend outside of the panels 62.

In operation, the glass sheets are slightly leaned against the cradle 52 during transportation in the container 10. In this manner, the sheets are supported against the back of the container and will not fall over when the container is opened or the front portion 12 is removed.

The cradle support surface 56 is shown having a generally elongated rectangular shape. Additionally, the support surface is slightly arcuate or curved (as shown in FIG. 5) to match the curve of the glass sheets. The contour of the support surface 56 allows the support surface 56 to more effectively engage the glass sheets and provide support during transportation and storage.

Referring again to FIG. 4, the interior of the container 10 also includes two corrugated cardboard glass sheet supports 74. The supports 74 are formed by combining several corrugated sheets so as to form a core. Each support 74 is in the shape of a beam extending along the bottom portion 28 from the front to the back of the container 10. The glass sheet supports 74 are positioned so that the cradle 52 is centered between the supports 74.

Figure 6:
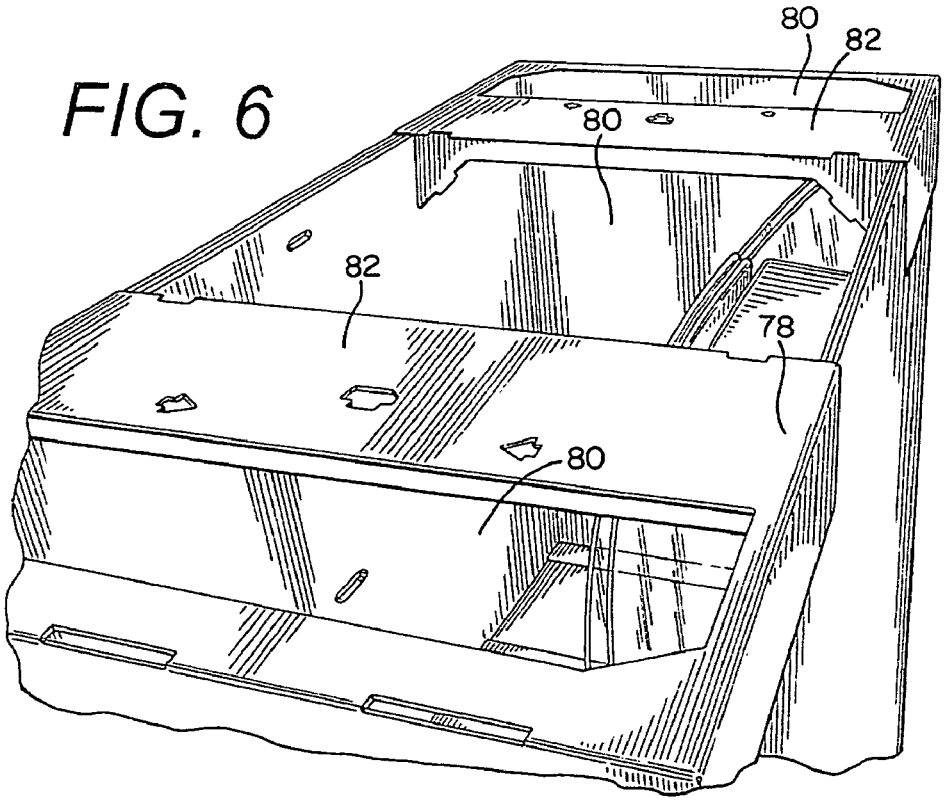
FIG. 6 is a perspective view of the top of one embodiment of a container for glass sheets in accordance with the present invention.

As illustrated in FIG. 6, a plurality of glass sheets 76 are shown positioned in the container 10. Each glass sheet 76 rests on its bottom (or top) edge on the bottom supports 74, and is held approximately upright in the container 10. The backmost glass sheet 76 is preferably positioned against the support surface 56 of the cradle portion 54.

As is evident in FIG. 6, the glass sheets 76 (in this case windshields for automobiles) are arcuate or curved. As described above, the contour of the supporting surface 56 is designed to mate with the curvature of the glass sheets 76. The glass sheets 76 are shown as having a concave curvature contacting a convex cradle support surface 56; however, the container can be configured so that the sheets 76 can be facing the other way where the convex side of the sheet 76 contacts a concave supporting surface 56.

FIG. 6 also shows a top portion 78 having a plurality of openings 80. The openings are separated by a segmented top wall 82.

An alternative embodiment of the container is shown in FIG. 7. In this embodiment, the top of the container 10 is formed from a first segment or flap 84 integrally connected as part of the front portion 12, and second segment or flap 86 integrally connected to the back portion 42 of the container 10. The flaps 84,86 collectively form a top wall for the container 10.

The flaps 84,86 include an indent or cutaway portion 88 that forms an opening in the top wall. This allows for easy visual inspection of the contents of the container 10.

FIG. 7 also illustrates how the front portion 12 can pivot to open and close the container 10. In this embodiment, the front portion 12 has similar dimensions as the rear portion 42 of the container.

In yet another alternative embodiment of the present invention, the container can include a single floor support 90 as illustrated in FIG. 8. The floor support 90 extends along substantially the entire upper portion of the pallet 30. The floor support 90 includes two tabs 92 that extend outwardly beyond the front portion of the pallet 30 which can be used to connect the floor support 90 to the front portion 12 of the container. Similarly, tabs extending from the rear of the floor support can be used to connect the floor support 90 to the rear portion 42 of the container. The floor support 90 includes cutaway portions 94 positioned to accommodate components of an alternative embodiment of the cradle.

Figure 9:
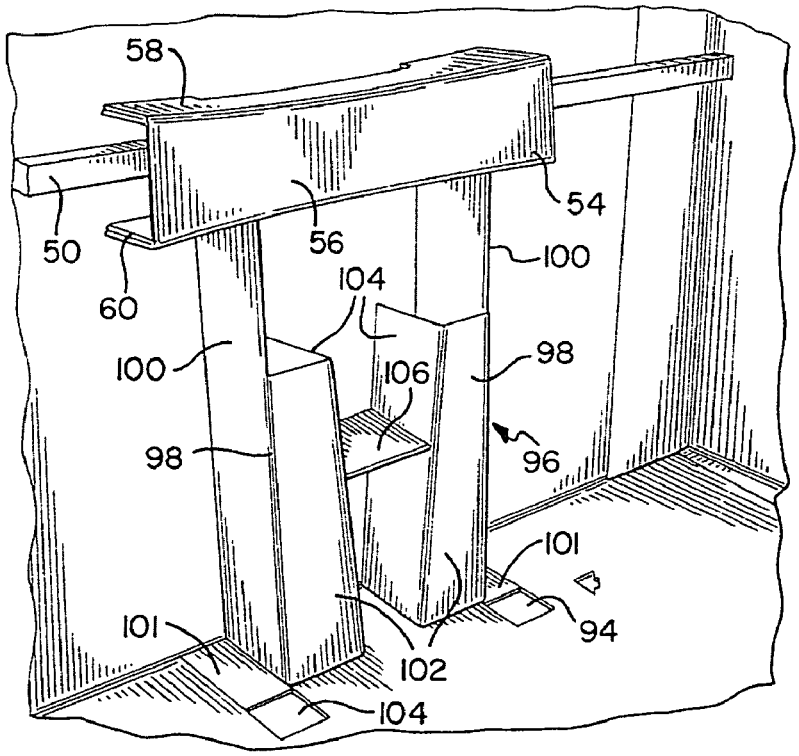
FIG. 9 is a perspective view of an alternative embodiment of the cradle portion.

FIG. 9 shows an alternative cradle 96. In this embodiment, the cradle portion 54 is supported by two support portions 98. The support portions 98 include a side panel 100 which extends from the bottom portion 28 of the container to the cradle portion 54. The bottom of the side panel 100 includes a flap 101 that is secured in the opening 94 in the bottom support 90. The lower two thirds of the support portion includes a front panel 102 integrally connected to the side panel 100 at one side, and an inner panel 104 integrally connected to the front panel 102 at its other side. A horizontal brace support 106 is fitted between the inner panels 104 of the support portions 98. The inner panels 104 can be provided with one or more slots to accommodate the brace support 106, or tabs extending from the brace support 106. Similarly, the back portion can also be provided with slots to accommodate the brace support 106 or tabs extending from the support.

Figure 10:
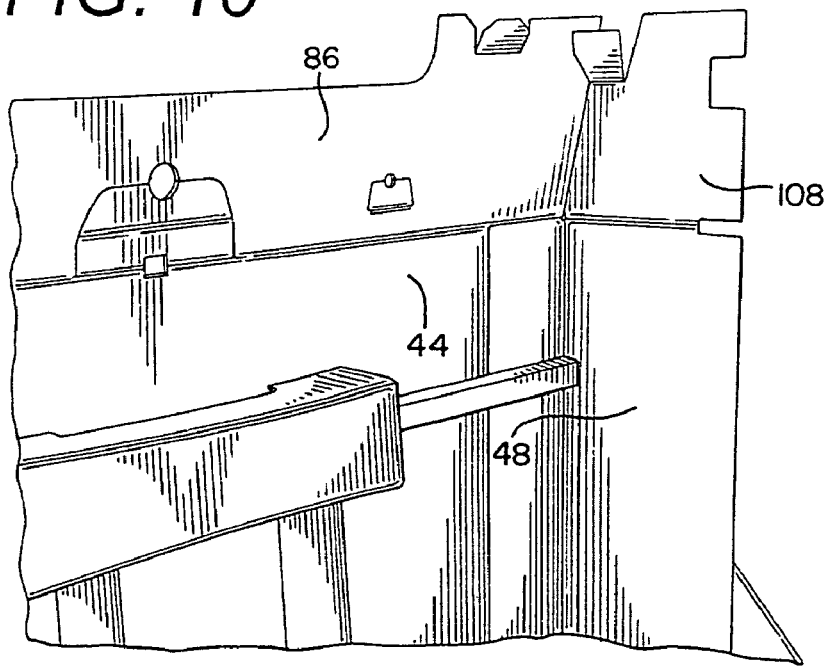
FIG. 10 is a perspective view of the interior side of a back portion of the container with an integral top portion; and, FIG. 11 is an exterior view of the back portion of the container.

FIG. 10 illustrates a top flap 86 extending from the back wall 44. Additionally, the side wall 48 can also include a flap 108 extending from the top of the side wall which can be used to form part of the top of the container. The opposing side wall 46 of the rear portion 42 and the side walls of the front portion 12 can also include flaps for use in the top portion.

Figure 11:
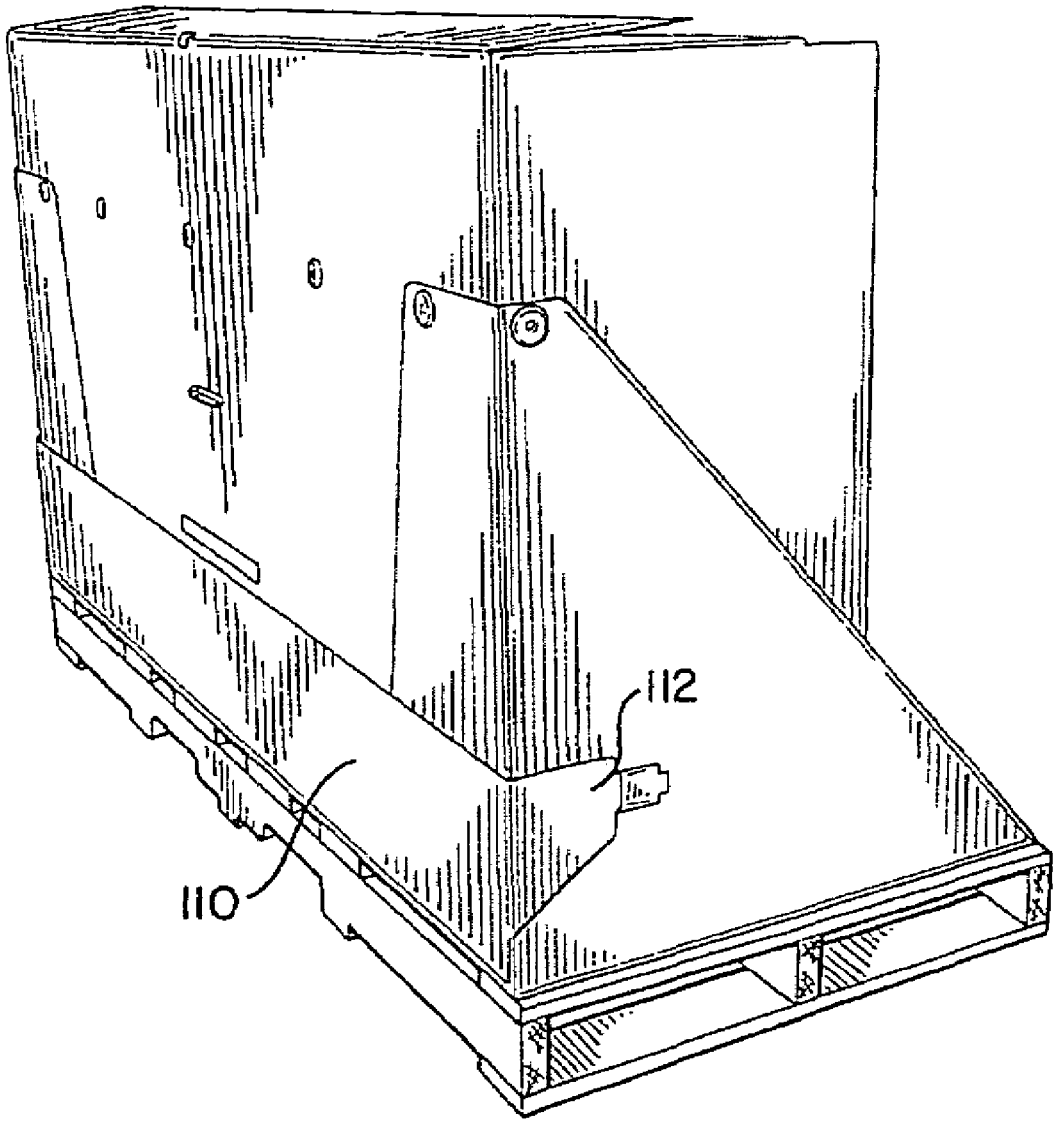

Additional support can also be provided to the back portion 42 of the container. As illustrated in FIG. 9 and FIG. 11, a lower back panel 110 spans from one side of the back of the container to the other side proximate the bottom of the container. The lower back panel 110 includes flaps 112 to facilitate connection to the side support portions 38 of the corner portions 36.

While the specific embodiments have been illustrated and described, numerous modifications come to mind without significantly departing from the spirit of the invention, and the scope of protection is only limited by the scope of the accompanying Claims.

What is claimed is:

1. A container for transporting a plurality of curved glass sheets lined up side by side comprising:

a bottom structure;

a back wall extending upward from the bottom structure;

a first side wall connected to a first end of the back wall and extending upward from the bottom structure and a second side wall connected to a second end of the back wall and extending upward from the bottom structure; and, a corrugated material cradle portion connected to the back wall extending into an interior portion of the container, the cradle portion positioned mid-way between the first side wall and the second side wall for contacting a center portion of the backmost one of the plurality of glass sheets, the cradle portion having a glass sheet supporting surface positioned in the interior portion of the container for contacting the backmost one of the plurality of glass sheets with a radius of curvature to mate with the backmost one of the plurality of glass sheets, the glass sheet supporting surface supported by a top member extending from the glass sheet supporting surface to the back wall and a bottom member extending from the glass sheet supporting surface to the back wall.

2. The container of claim 1 further comprising a first cradle support panel extending upward from the bottom structure to the cradle portion.

3. The container of claim 2 wherein the first cradle support panel includes a front support surface inclined at an angle to the back wall of the container.

4. The container of claim 1 further comprising a reinforcing member extending along the back wall between the first side wall and the second side wall.

5. The container of claim 4 wherein the cradle portion is positioned about the reinforcing member with the top member above the reinforcing member and the bottom member below the reinforcing member.

6. The container of claim 1 wherein the bottom structure is a pallet.

7. The container of claim 1 wherein the back wall, first side wall, and second side wall are formed from a corrugated material.

8. The container of claim 1 further comprising:

a first corner support structure configured to support a portion of the first side wall and a first portion of the back wall adjacent the portion of the first side wall; and, a second corner support structure configured to support a portion of the second side wall and a second portion of the back wall adjacent the portion of the second side wall.

9. The container of claim 1 further comprising a front wall extending upward from the bottom structure and a top panel extending between the front wall and the back wall, and the first side wall and the second side wall.

10. A container for transporting a plurality of curved glass sheets comprising:

a bottom pallet structure;

a substantially rectangular corrugated cardboard back wall connected to a back edge portion of the bottom pallet structure and extending upward therefrom and including a corrugated cardboard first side wall connected to a first side of the back wall and a corrugated cardboard second side wall connected to a second side of the back wall;

a corrugated cardboard cradle portion connected to a mid-portion of the back wall for engaging and supporting the plurality of curved glass sheets;

a corrugated cardboard first corner support having a side support wall for supporting a lower corner portion of the first side wall and a back support wall for supporting a first portion of the back wall; and, a corrugated cardboard second corner support having a side support wall for supporting a lower corner portion of the second side wall and a back support wall for supporting a second portion of the back wall.

11. The container of claim 10 wherein the cradle portion includes a curved cradle support surface having a contour configured to closely follow the contour of the backmost curved glass sheet of the plurality of curved glass sheets.

12. The container of claim 10 further comprising a front wall having a first side wall connected to a first side of the front wall and a second side wall connected to a second side of the front wall wherein the first side wall and the second side wall connected to the front wall are configured to overlap the first side wall and second side wall connected to the back wall.

13. The container of claim 10 wherein the bottom pallet structure includes a floor portion comprising a corrugated cardboard material.

14. The container of claim 12 further comprising a corrugated cardboard top panel having a lip extending downward around the periphery of the top panel, the lip being reinforced to resist pressure from banding of the container.

15. The container of claim 11 further comprising a reinforcing beam extending along the back wall.

16. The container of claim 15 wherein the cradle support surface of the cradle portion is positioned proximate the reinforcing beam.

17. The container of claim 16 wherein the cradle portion includes a wall separation portion connected to the back wall and the cradle support surface for maintaining the cradle support surface in an interior portion of the container spaced from the back wall, wherein the wall separation portion spans a portion of the reinforcing beam.

18. A container for transporting a plurality of glass windshields used for automobiles comprising:

a bottom structure;

a back wall connected to the bottom structure along a bottom edge of the back wall and including a first side wall extending from a first side of the back wall and a second sidewall extending from a second side of the back wall, the back wall, first side wall and second side wall formed from a contiguous corrugated cardboard blank;

a corrugated cardboard cradle portion connected to the back wall and including a generally rectangular support surface having a curvature following the curvature of the plurality of glass windshields;

a first corner support having a side supporting portion for supporting a portion of the first side wall and a back supporting portion for supporting a first portion of the back wall, the side supporting portion and the back supporting portion of the first corner support formed from a contiguous corrugated cardboard blank; and, a second corner support having a side supporting portion for supporting a portion of the second side wall and a back supporting portion for supporting a second portion of the back wall, the side supporting portion and the back supporting portion of the second corner portion formed from a contiguous corrugated cardboard blank.

19. The container of claim 18 further comprising a front portion connected to the bottom structure, the front portion including a front wall, a first side wall connected to a first side of the front wall and a second side wall connected to a second side of the front wall, wherein the front wall, first side wall connected to the front wall and second side wall connected to the front wall are formed from a contiguous corrugated cardboard blank.

20. The container of claim 19 further comprising a corrugated cardboard top portion including a top panel surrounded by a lip having a roll-up reinforcement to withstand banding pressure.

* * * * *